US006796007B1

(12) United States Patent
Anscher

(10) Patent No.: US 6,796,007 B1
(45) Date of Patent: Sep. 28, 2004

(54) BUCKLE ASSEMBLY

(76) Inventor: Joseph Anscher, 1928 Midlane, Muttontown, NY (US) 11791

( * ) Notice: Subject to any disclaimer, the term of this patent is extended or adjusted under 35 U.S.C. 154(b) by 0 days.

(21) Appl. No.: 10/425,221

(22) Filed: Apr. 29, 2003

(51) Int. Cl.[7] ..... A44B 11/25

(52) U.S. Cl. ..... 24/633; 24/615; 24/625; 24/630; 24/579.11; 24/312

(58) Field of Search ..... 24/633, 630, 625, 24/614, 615, 312, 573.1, 579.11; 297/13, 467, 484

(56) References Cited

U.S. PATENT DOCUMENTS 4,831,694 A * 5/1989 Kong ..... 24/625
5,220,713 A * 6/1993 Lane et al. ..... 24/633
5,311,649 A * 5/1994 Suh ..... 24/625
5,438,737 A 8/1995 Anscher et al.
5,908,223 A * 6/1999 Miller ..... 297/484
5,996,192 A 12/1999 Haines et al.
6,052,875 A * 4/2000 Fudaki ..... 24/615
6,393,677 B1 5/2002 Anscher
6,408,494 B1 * 6/2002 Anscher ..... 24/625
6,421,889 B1 * 7/2002 Chien ..... 24/614
6,606,770 B1 * 8/2003 Badrenas Buscart ..... 24/625

* cited by examiner

*Primary Examiner*—Victor Sakran
(74) *Attorney, Agent, or Firm*—Collard & Roe, P.C.

(57) ABSTRACT

A buckle mechanism comprises a female portion and at least one male portion adapted to be received within the cavity of the female portion. The male portion has a base, a central leg with a catch and a locking tab. The locking tab seats in the locking slot when the male portion is inserted into the female portion. There is a center button mechanism mounted in the female portion and having a center push button, a spring connected to the center push button and/or to a spring base and at least one flexible leg connected to the spring base. The flexible leg has a catch that interlocks with the catch on the male portion when the male portion is inserted into the female portion. When the center push button is depressed, the spring compresses and causes the flexible leg to bend and release the catch on the male portion so that the male portion is ejected from the female portion when the locking tab is depressed sufficiently to clear the locking slot.

17 Claims, 5 Drawing Sheets

BUCKLE ASSEMBLY

BACKGROUND OF THE INVENTION

1. Field of the Invention

This invention relates to a buckle mechanism for use in a 3- or 5-point harness system. In particular, the invention relates to a side-release buckle having two male portions inserted into a female portion, and a central interlocking button mechanism, so that both the locking tabs on the male portions and the central interlocking button mechanism must be depressed to release the male portions.

2. The Prior Art

Many juvenile products, such as strollers and high chairs, utilize 3- or 5-point harness systems to keep the child restrained within the product. In a 3-point system, there are two waist straps and a crotch strap that are all connected via a buckle. In a 5-point system, there are two waist straps, two shoulder straps and a crotch strap. Buckles that are used to connect all of these straps to form the harness typically consist of a female portion and two male portions that snap into the female portion. The crotch strap is connected to the female portion and the waist and shoulder straps (if it is a 5-point harness) are attached to the male portions. The male portions can be released using either a side-release system or a center push button.

Side release buckles that are suitable for use in a 3- or 5-point harness system are shown in U.S. Pat. No. 5,438,737 to Anscher et al. and U.S. Pat. No. 5,996,192 to Haines et al. Another side release buckle is manufactured by Tifco. A center push buckle that is suitable for use in a 3- or 5-point system is shown in U.S. Pat. No. 6,393,677 to Anscher. While these buckles adequately connect the various straps of the harness systems and allow the straps to be easily released, they have the disadvantage that the buckles could be inadvertently released.

SUMMARY OF THE INVENTION

It is therefore an object of the invention to provide a buckle that can be used in a 3- or 5-point harness system and which cannot be released unintentionally.

It is another object of the invention to provide a buckle that is durable and easy to operate. It is yet another object of the invention to provide a buckle that is simple and inexpensive to manufacture.

These and other objects are accomplished by a buckle mechanism comprising a female portion and at least one male portion adapted to be received within a cavity of the female portion. The male portion has a base, a central leg with a catch and a flexible arm with a locking tab on one end. The locking tab seats in a locking slot of the female portion when the male portion is inserted into the female portion. The base of the male portion is preferably disposed at an angle from the central leg of the male portion. There is a center button mechanism mounted in the female portion and having a center push button, a spring connected to the center push button at one end and/or to a spring base at the other end, and at least one flexible leg connected to the spring base. The flexible leg has a catch that interlocks with the catch on the male portion when the male portion is inserted into the female portion. When the center push button is depressed, the spring compresses and causes the flexible leg to bend and release the catch on the male portion so that the male portion is ejected from the female portion when the locking tab is depressed sufficiently to clear the locking slot in the female portion.

In a preferred embodiment, there are two male portions, two locking slots in the female portion, and two flexible legs on the center button mechanism. Preferably, the center button mechanism is disposed between the two male portions when the male portions are inserted into the female portion.

The center button mechanism preferably has two wings extending from the center push button toward the spring base. Each wing preferably has a tapered inner surface, and depressing the center push button causes ends of the flexible legs to contact and slide along the tapered surfaces and thus be bent to release the catch on the male portions. The spring is preferably a compression spring but other types of springs could also be used.

The female portion preferably has an aperture in its bottom section. The center button mechanism is preferably mounted in the female portion by inserting the center button mechanism up into the female portion through the aperture. The center button mechanism is permanently locked to the female portion via locking legs mounted on the spring base. The locking legs engage a section of the female portion to lock the center button mechanism within the female portion when the center button mechanism is inserted through the aperture. Other types of arrangements for locking the center button mechanism within the female portion could also be used, such as a post and aperture arrangement, or any other suitable arrangement. This is an easy way to mount the center button mechanism within the female portion, if the center button mechanism is formed from one piece as a unitary component. However, the center button mechanism could also be formed as two pieces, with the flexible legs attached to the base and the spring attached only to the base or the center push button. In this arrangement, the center button can be mounted from the top and the spring base could be mounted from the bottom of the female portion. Other mounting arrangements could also be envisioned, depending on the structure of the center button mechanism and the female portion.

There is preferably at least one alignment rib disposed on an inner surface of the female portion. The alignment rib causes the one male portion to be inserted into the female portion in a properly aligned manner. There are preferably four alignment ribs corresponding to each male portion, in an arrangement such that the ribs are located two on one side and two on the opposite side of the female portion and create a guide track for the flexible leg of the male portion. There is preferably a space between the opposing ribs so that the catch on the male portion protrudes between the two ribs to interact with the catch on the center button mechanism when the male portion is inserted in the female portion. When the locking tabs on the male portions are depressed, the leg of the male portion contacts the ribs, and the ribs exert counter pressure against the legs to eject the male portion out of the female portion when the center push button is also depressed. The ribs could also take other arrangements and forms than specifically described here.

There is preferably at least one strap threading bar on the male portion to allow a strap to be threaded through the bar and thus be attached to the male portion. There is also preferably at least one strap threading bar disposed on the female portion to allow a strap to be threaded through the bar and thus be attached to the female portion.

The center button mechanism is preferably integrally molded from one piece, but multi-piece arrangements could also be used. The preferred material for the buckle mechanism according to the invention is a stiff plastic such as Delrin®, but other materials could also be used.

To eject the male portions from the female portion, both the center push button and the locking tabs must be depressed. Depressing the center push button causes the flexible legs on the center button mechanism to bend inward and release the catch that interacts with the catch on the leg of the male portion. Depressing the locking tab on the male portion while the center push button is depressed allows the male portion to be ejected from the female portion. The locking tabs and the center push button can be depressed simultaneously using the fingers of one hand to release the male portions from the female portion. The male portions can be inserted and ejected independently of each other or together.

The present invention provides an added measure of security to harness systems, because two actions must be taken to release the buckle mechanism: the center push button and the locking tabs must be depressed together to eject the male portions from the female portion.

BRIEF DESCRIPTION OF THE DRAWINGS

Other objects and features of the present invention will become apparent from the following detailed description considered in connection with the accompanying drawings. It is to be understood, however, that the drawings are designed as an illustration only of a preferred embodiment and not as a definition of the limits of the invention.

In the drawings, wherein similar reference characters denote similar elements throughout the several views.

DETAILED DESCRIPTION OF THE PREFERRED EMBODIMENT

Figure 1:
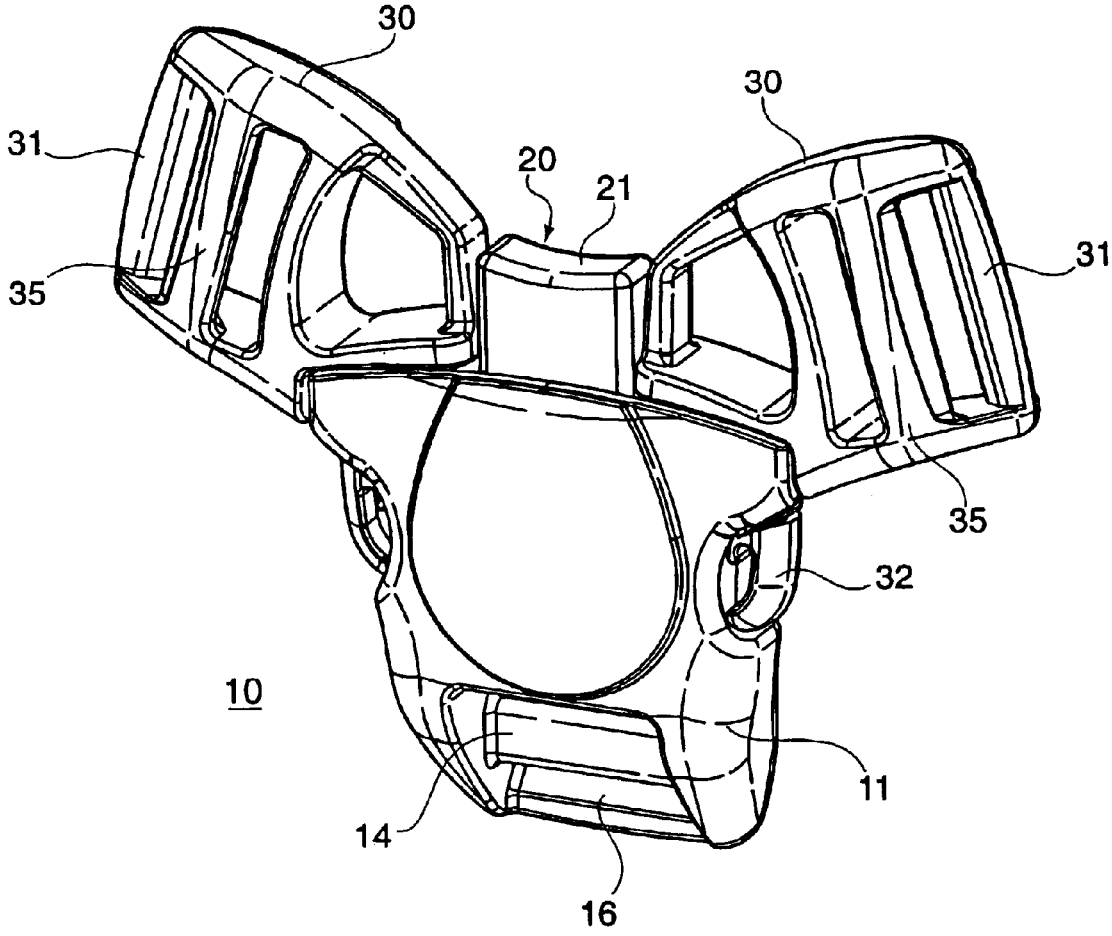
FIG. 1 shows a perspective view of a preferred embodiment of the buckle according to the invention.

Referring now in detail to the drawings, FIG. 1 shows a preferred embodiment of a buckle mechanism 10 according to the invention in the assembled position. Buckle mechanism 10 is comprised of a female portion 11 and two male portions 30, which are inserted into female portion 11. Male portions 30 each have strap retaining bars 31, 35 to allow a waist and/or shoulder strap to be threaded therethrough. Female portion 11 has strap retaining bars 14, 16 to allow a crotch strap to be threaded therethrough. This way, buckle mechanism 10 can be used in a 3- or 5-point harness system for restraining infants and toddlers in various juvenile products, such as high chairs and strollers. In a 3-point harness only a waist strap or a shoulder strap is attached to male portions 30, while in a 5-point harness, both waist and shoulder straps are used. Instead of having two separate pieces of webbing for the waist and shoulder straps, the straps can be formed by threading a single piece of webbing through one of the bars, and have one end extend up toward the shoulder and the other end extend around the waist. Various types of strap arrangements can be used with the buckle mechanism 10.

Figure 2:
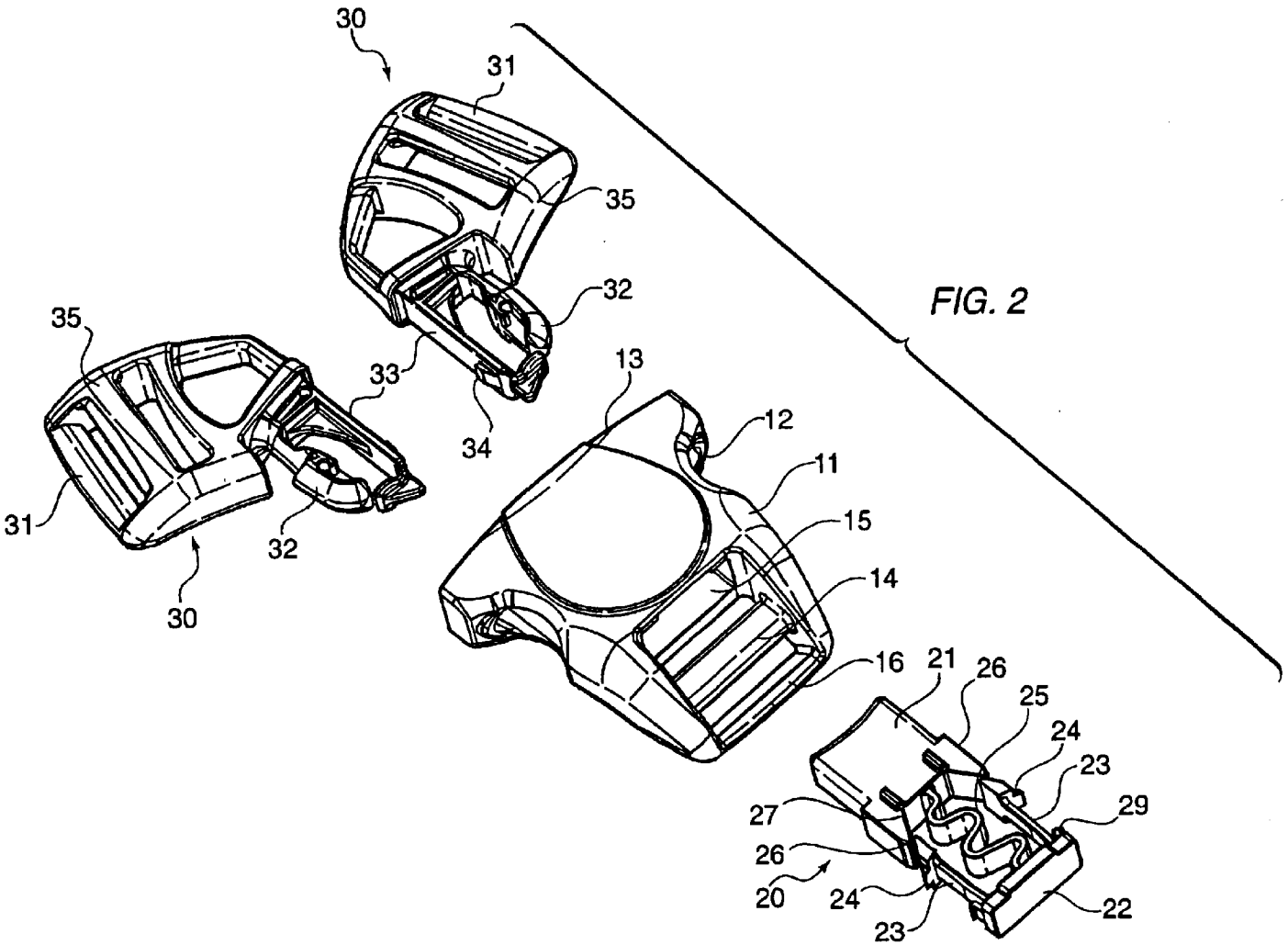
FIG. 2 shows an exploded view of the buckle of FIG. 1.

FIG. 2 shows an exploded view of all of the components of buckle mechanism 10. Female portion 11 has a hollow interior with an open top 13, two locking slots 12 disposed on each side of female portion 11, two strap retaining bars 14, 16, described above, and a lower aperture 15.

Male portions 30 each comprise a base 35, strap retaining bars 31, 35, described above, a flexible arm with a locking tab 32, a center arm 33 and a catch 34 disposed on the center arm. Male portions 30 are each inserted into female portion 11 until locking tabs 32 snap into locking slots 12 on female portion 11, as shown in FIG. 1.

In addition to male portions 30 and female portion 11, there is a center button mechanism 20, which is mounted inside female portion 11, by inserting center button mechanism 20 up through aperture 15 in female portion 11. Center button mechanism 11 is permanently mounted inside female portion 11 when locking tabs 29 mounted on the base 22 of center button mechanism 11 engage corresponding locking tabs (not shown) on the inside of female portion 11. Alternative arrangements, such as a post and aperture arrangement, could also be used for locking center button mechanism to female portion 11.

Center button mechanism 20 comprises a center push button 21, having downwardly extending wings 26 with a sloped inner surface 27. Attached to button 21 is a spring 25. The other end of spring 25 is connected to base 22. Also connected to base 22 are flexible legs 23, which each have a catch 24 attached at the free end of flexible legs 23. In an alternative embodiment, spring 25 is attached only to one of button 21 or base 22, so that center button mechanism 20 is a two piece mechanism. Other arrangements could also be envisioned. In this two-piece mechanism, other arrangements for mounting mechanism 20 into female portion 11 could be envisioned as well, such as mounting button 21 through the top 13 of female portion 11.

Figure 5:
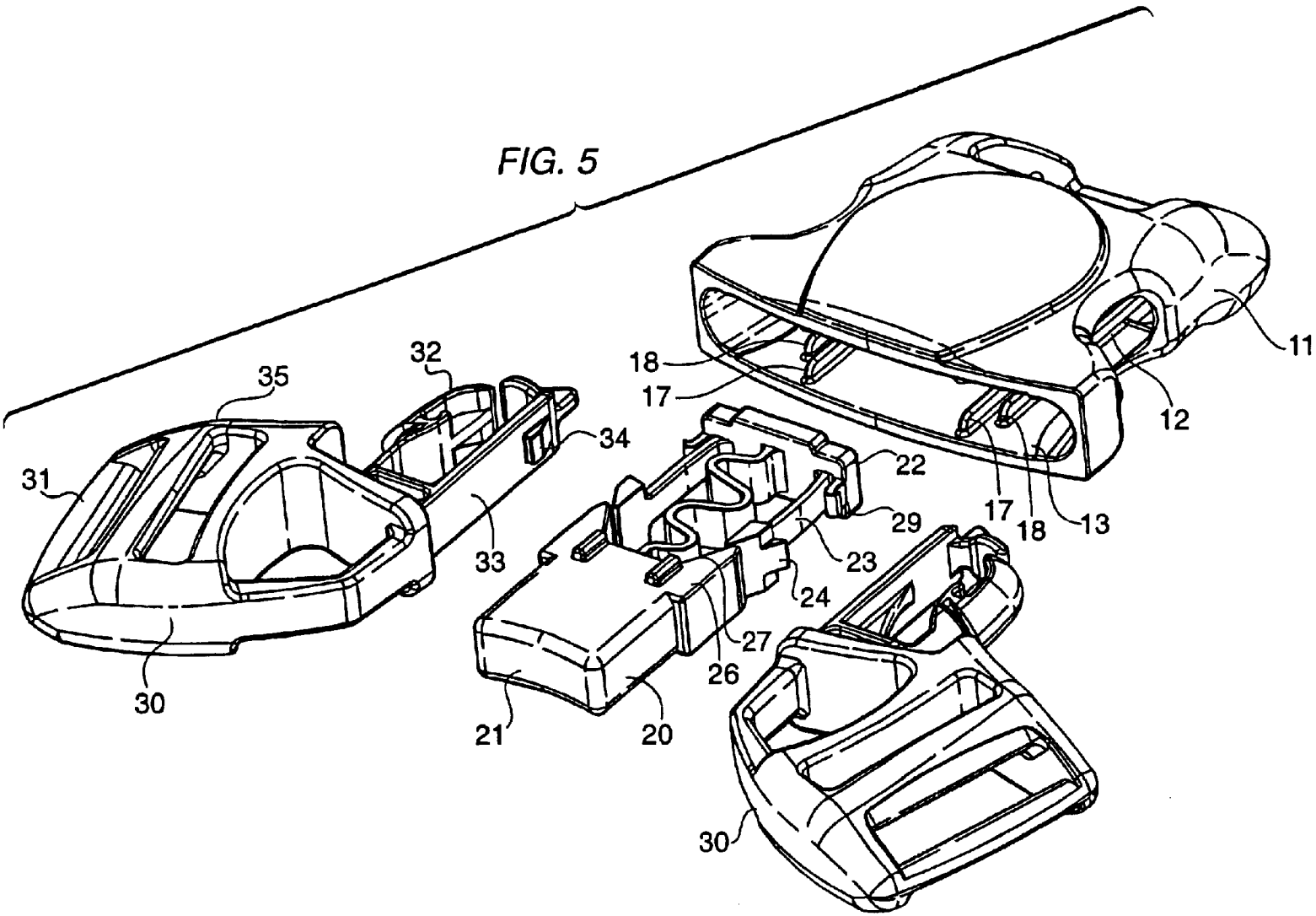
FIG. 5 shows another exploded view of the buckle.

FIG. 5 also show another exploded view of buckle mechanism 10. As shown in FIG. 5, female portion 11 has a series of opposing ribs 17, 18 mounted on its inside surface. Ribs 17, 18 create a guide track for legs 33 of male portions 30 as they are inserted into female portion 11, and also form a surface that creates counter pressure against legs 33 to allow male portions 30 to be ejected from female portion 11 when locking tabs 32 are pressed inward. When male portions 30 are locked into female portion 11, catches 34 extend through the gap between the opposing ribs 17 so as to interact with catch 24 on center button mechanism 20.

Figure 3:
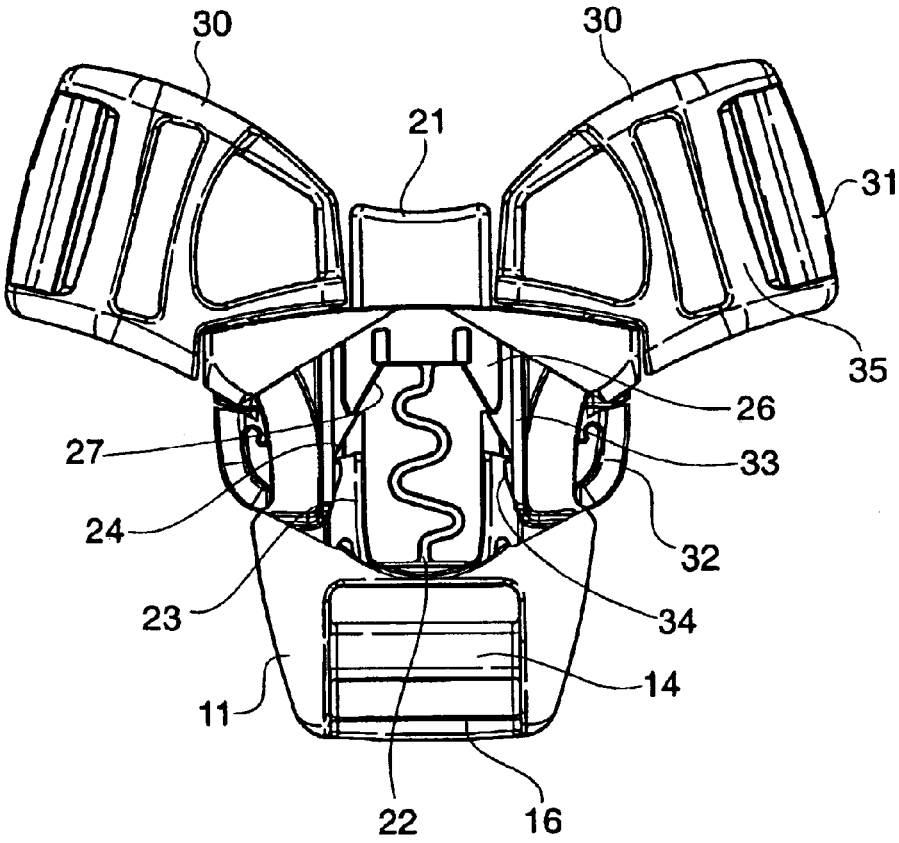
FIG. 3 shows a front view of the buckle of FIG. 1 in a resting position with the central portion cut-away to show the interior of the buckle.
Figure 4:
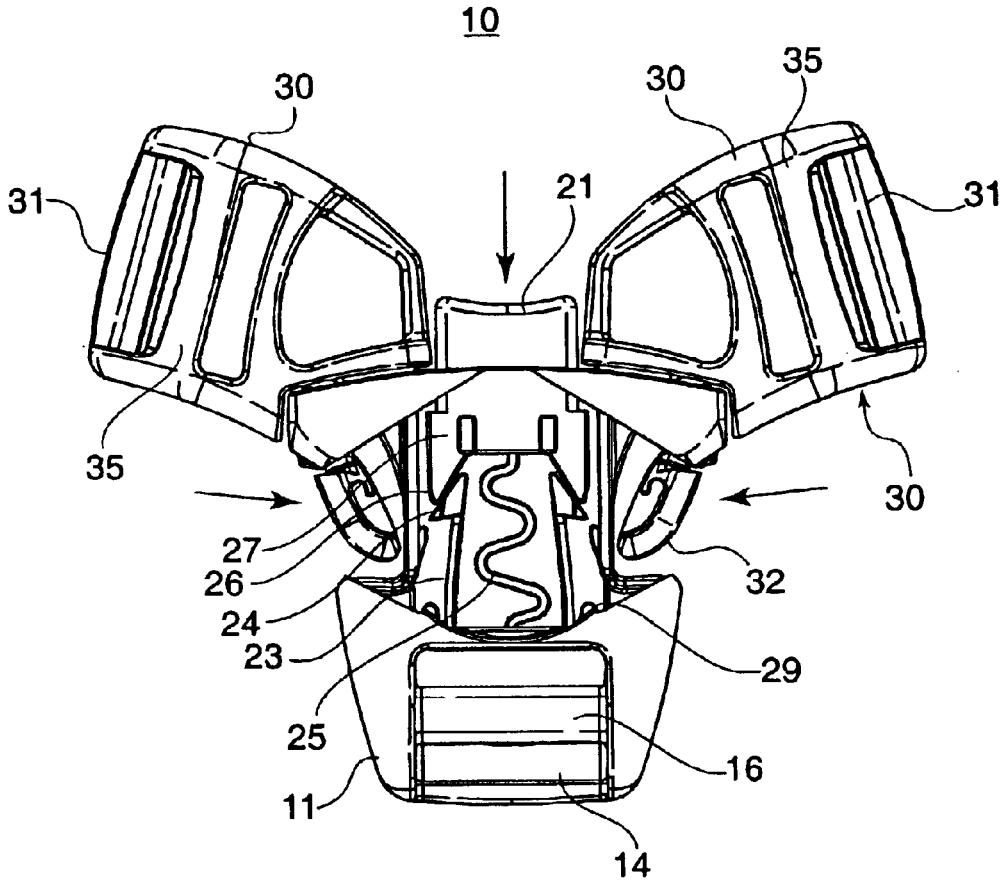
FIG. 4 shows the same view of the buckle of FIG. 3, but with the center button depressed.

The operation of buckle mechanism 10 is shown in FIGS. 3 and 4. In a resting position as shown in FIG. 3, male portions 30 are locked into female portion 11 via locking tabs 32 extending through locking slots 12. In addition, catch 34 on leg 33 of male portion 30 engages catch 24 on leg 23 of center button mechanism 20. This interlocking catch engagement creates an additional lock to prevent male portions 30 from being inadvertently disengaged from female portion 11. The catches are configured so that male portions 30 easily slide into female portion 11 and over catch 24 until catch 24 engages catch 34, and locking tabs 32 snap into locking slots 12.

The release of male portions 30 is shown in FIG. 4. To release male portions 30, center push button 21 must be depressed sufficiently to bias spring 25 and cause flexible legs 23 to bend inward. This causes catches 24 to slide along tapered surfaces 27 of center push button 20 until catches 24 are released from catch 34 on male portions 30. At the same time, depressing locking tabs 32 a sufficient amount to clear locking slots 12 will cause legs 33 to bias against ribs 17 and allow male portions 30 to be ejected from female portion 11. Center push button 21 must remain depressed during the ejection process, until male portion 30 slides out of female portion 11 enough to cause catches 34 on male portion 30 to pass above catches 24 on center button mechanism 20. Thus, both center push button and locking tabs 32 must be depressed in order to release male portions 30 from female portion 11. Buckle mechanism 10 is also configured to allow only one male portion to be ejected. The ejection process is the same as above, except that only one locking tab 32 is pressed. Male portions 30 can also be inserted one at a time into female portion 11, as they are locked to female portion 11 independently of each other.

Accordingly, while only a single embodiment of the present invention has been shown and described, it is obvious that many changes and modifications may be made thereunto without departing from the spirit and scope of the invention.

What is claimed is:

1. A buckle mechanism comprising:

a female portion having an inner cavity, an open top and at least one locking slot;

at least one male portion adapted to be received within the cavity of the female portion through said open top, said male portion having a base, a central leg, a catch on said central leg and a locking tab, said locking tab seating in said locking slot when said male portion is inserted into said female portion; and a center button mechanism mounted in said female portion and comprising a center push button, a spring arranged between said center push button and a spring base, at least one flexible leg connected between said spring base, and said push button said flexible leg having a catch that interlocks with the catch on the male portion when said male portion is inserted into said female portion, wherein when said center push button is depressed, said spring compresses and causes said flexible leg to bend and release the catch on the male portion which allows said locking tab to be depressed so that the male portion is ejected from the female portion when the locking tab is depressed by the central push button sufficiently to clear the recess in the female portion.

2. The buckle mechanism according to claim 1, wherein there are two male portions, two locking slots in the female portion, and two flexible legs on the center button mechanism.

3. The buckle mechanism according to claim 2, further comprising two wings extending from the center push button toward the spring base, each wing having a tapered inner surface, wherein depressing the center push button causes ends of the flexible legs to contact and slide along the tapered surfaces and thus be bent to release the catch on the male portions.

4. The buckle mechanism according to claim 1, further comprising an aperture in a bottom section of said female portion opposite said open top, wherein said center button mechanism is mounted in the female portion by inserting the center button mechanism up into the female portion through the aperture.

5. The buckle mechanism according to claim 4, wherein said center button mechanism is permanently locked to said female portion after the center button mechanism is inserted through said aperture.

6. The buckle mechanism according to claim 5, wherein the button mechanism is permanently locked via locking legs mounted on said spring base, said locking legs engaging a section of said female portion to lock the center button mechanism within said female portion when said center button mechanism is inserted through said aperture.

7. The buckle mechanism according to claim 1, further comprising at least one alignment rib disposed on an inner surface of said female portion, said alignment rib causing said at least one male portion to be inserted into the female portion in a properly aligned manner.

8. The buckle mechanism according to claim 7, wherein there are four alignment ribs corresponding to each male portion, two of said four alignment ribs being disposed on one wall of the male portion and the other two of said four alignment ribs being disposed on an opposite wall, such that there are two sets of two ribs facing each other with a space between each set of facing ribs.

9. The buckle mechanism according to claim 1, further comprising at least one strap threading bar on said at least one male portion to allow a strap to be threaded through said at least one bar and thus be attached to said male portion.

10. The buckle mechanism according to claim 1, further comprising at least one strap threading bar disposed on the female portion to allow a strap to be threaded through the at least one bar and thus be attached to the female portion.

11. The buckle mechanism according to claim 1, wherein the spring is connected to one of the center push button or spring base.

12. The buckle mechanism according to claim 1, wherein the center button mechanism is integrally molded from one piece and wherein the spring is connected to both the center push button and to the spring base.

13. The buckle mechanism according to claim 1, wherein the spring is a compression spring.

14. The buckle mechanism according to claim 7, wherein the leg of the at least one male portion contacts said at least one rib when said locking tab is depressed, and wherein said at least one rib exerts counter pressure against said leg to eject said male portion out of said female portion when said center push button is also depressed.

15. The buckle mechanism according to claim 2, wherein the locking tabs and the center push button can be depressed simultaneously using the fingers of one hand to release the male portions from the female portion.

16. The buckle mechanism according to claim 1, wherein the base of the male portion is disposed at an angle from the leg of the male portion.

17. The buckle mechanism according to claim 2, wherein the center button mechanism is disposed between the two male portions.

* * * * *